US011761192B1

(12) United States Patent
Conder et al.

(10) Patent No.: US 11,761,192 B1
(45) Date of Patent: Sep. 19, 2023

(54) WASTEWATER BASIN

(71) Applicant: ZOELLER PUMP COMPANY, LLC, Louisville, KY (US)

(72) Inventors: Jeremy Conder, Louisville, KY (US); Chris Knaster, Louisville, KY (US); James C. Erhart, Louisville, KY (US)

(73) Assignee: Zoeller Pump Company, LLC, Louisville, KY (US)

( * ) Notice: Subject to any disclaimer, the term of this patent is extended or adjusted under 35 U.S.C. 154(b) by 246 days.

(21) Appl. No.: 17/149,813

(22) Filed: Jan. 15, 2021

Related U.S. Application Data

(62) Division of application No. 16/515,107, filed on Jul. 18, 2019, now Pat. No. 10,907,340.

(51) Int. Cl.
*E03F 11/00* (2006.01)
*B65D 25/00* (2006.01)

(52) U.S. Cl.
CPC ..... *E03F 11/00* (2013.01); *B65D 25/00* (2013.01)

(58) Field of Classification Search
CPC ..... F04B 39/14; B65D 25/00; E03F 11/00
USPC ..... 220/567.1, 565, 4.04, 4.05
See application file for complete search history.

(56) References Cited

U.S. PATENT DOCUMENTS 5,806,702 A * 9/1998 Sabo ..... E03F 11/00 220/4.12
8,523,532 B1 * 9/2013 Pohler ..... E03F 5/00 417/40
2019/0221913 A1 * 7/2019 Castronova ..... H01Q 1/44

FOREIGN PATENT DOCUMENTS

DE 2441987 * 3/1975

* cited by examiner

*Primary Examiner* — Sunil Singh
(74) *Attorney, Agent, or Firm* — Scott R. Cox; Jessica C. Ronald; Jeffery Langer

(57) ABSTRACT

A molded basin for use with a submersible sump, sewage or grinder pump. The molded construction of the basin permits design improvements to be incorporated into the basin including bolt down slots in a bottom flange of a bottom of the basin, a molded inner basin mounting surface for a float tree, a molded inner surface support mount to receive a bracket of a rail system used to raise and lower the pump within the basin, a disc that fits within the basin and is supported by a molded inner facing horizontal rib to create a wet/dry well and structural features present in a top surface of the basin and a cover for the basin to close said basin. Extension risers may be added to extend the height of the basin, wherein the extension risers contain many of the same structural features that are present in the basin.

12 Claims, 15 Drawing Sheets

WASTEWATER BASIN

CROSS REFERENCE TO RELATED APPLICATION

This application is a divisional application based on U.S. application Ser. No. 16/515,107, filed Jul. 18, 2019, which issued as U.S. Pat. No. 10,907,340 on Feb. 2, 2021, and which claimed priority to U.S. Provisional Application No. 62/798,035, filed Jan. 29, 2019, the disclosures of which are herein incorporated by reference in their entirety.

BACKGROUND OF INVENTION

This invention relates to wastewater basins for use with submersible sump, sewage and grinder pumps, which includes novel features to permit the fast, precise and secure installation and adaption of the basin for a wide range of different requirements, such as utilization with a pump raising rail system, adaptability for securing a float tree of the pump at a precise position within the basin, capability of creating a wet well/dry well arrangement at different levels within the basin, and adoptability to add extension risers to the basin to increase the height of the basin and its storage capacity.

Submersible pumps are often installed in underground tanks or sumps that handle hazardous or toxic liquids, such as sewage. Installation of such submersible pumps in these underground tanks has significant installation costs and difficulty in securing of the submersible pumps, and its associated components, within the basin. Further, maintenance of submersible pumps within these basins often requires drainage of the sump followed by lengthy repair work. To lessen the expense and time, lift out guide rail systems now are common for use with submersible pumps in these basins.

Significant problems often occur with the installation and maintenance of these basins. For example, because basins are installed within the ground, it is necessary that they have strength, reliability and ease in securing the basins at a specific location within the ground. Further, it is important that these basins are prevented from floating upwards after installation from hydraulic pressure.

In addition, basins must accommodate important elements of the wastewater systems, such as a float tree with floats that are utilized with wastewater pumps.

Further, it is important that access to the inside of the basin be convenient, while at the same time, the top of the basin must be securely closed.

To provide flexibility in the capacity and depth of installation of these basins, it is important to provide for the possibility of adding extension risers to the basins to increase the height and capacity of the basin.

Further, such basins should be designed to permit the establishment of wet well/dry well portions within the basin, wherein the dry well portion is an area that can be used by a workman to work on components of the wastewater system and the wet well portion contains the wastewater pump and related components within the wastewater. It is also useful if the configuration of the basin can be modified to accommodate different relative volumes for the wet well and the dry well portions of the basin.

One object of the disclosure is a basin for use with a submersible sump, sewage or grinder pump that includes a basin body, preferably molded, with a generally cylindrical wall with an inner wall surface and an outer wall surface, an open top, a closed bottom with an inner surface and a bottom flange secured to and extending outward from the closed bottom containing bolt down slots, and a cover to close the open top of the basin body, wherein the inner wall surface of the basin body includes an inner surface receiving molded bracket or brackets to secure a float tree of the submersible pump within the basin.

Another object of the disclosure is a wastewater basin for use with a submersible sump, sewage or grinder pump that includes a basin body, preferably molded, with a generally cylindrical wall with an inner wall surface and an outer wall surface, wherein the inner wall surface of the basin body includes a molded inner surface support mount used to secure a guide rail system for the submersible pump within the basin, an open top, a closed bottom, a bottom flange secured to the closed bottom, and a cover to close the open top of the basin body. The basin further includes a wet/dry well barrier that is securable within the basin at varying depths therein to form a barrier between a wet well portion and a dry well portion of the basin, wherein the barrier consists of a disc containing a ring portion supported on a inner facing horizontal molded rib of the inner wall surface of the basin, and wherein the inner wall surface includes multiple inner facing horizontal molded ribs to permit modification of the depth of placement of the wet/dry well barrier within the sump.

Another object of the disclosure is a wastewater basin for use with a submersible sump, sewage or grinder pump that includes a basin body with an open top, a closed bottom, and a cover to close the open top of the basin body, wherein the cover includes a lower surface wherein extrusion elements are sized to fit into openings cut in a top surface of the open top of the basin body.

Another object of the invention is a wastewater basin for use with a submersible sump, sewage or grinder pump that includes a basin body including a generally cylindrical wall, an open top, and a closed bottom, and further including one or more extension risers of similar diameter to a diameter of the basin body containing a top surface with slots therein and a bottom surface containing extension lugs which fit within slots of a top surface of the top of the basin body. The extension risers may have different heights to modify the overall depth of the basin. A cover to close the open top of the extension riser is also an element of this embodiment.

DESCRIPTION OF A PREFERRED EMBODIMENT OF THE INVENTION

With reference to the drawings, in particularly FIGS. 1 through 14, there is disclosed a wastewater basin (10) for use with sump, sewage and grinder pumps (70) containing new and improved design features providing adaptability and usability under varying conditions.

Figure 1:
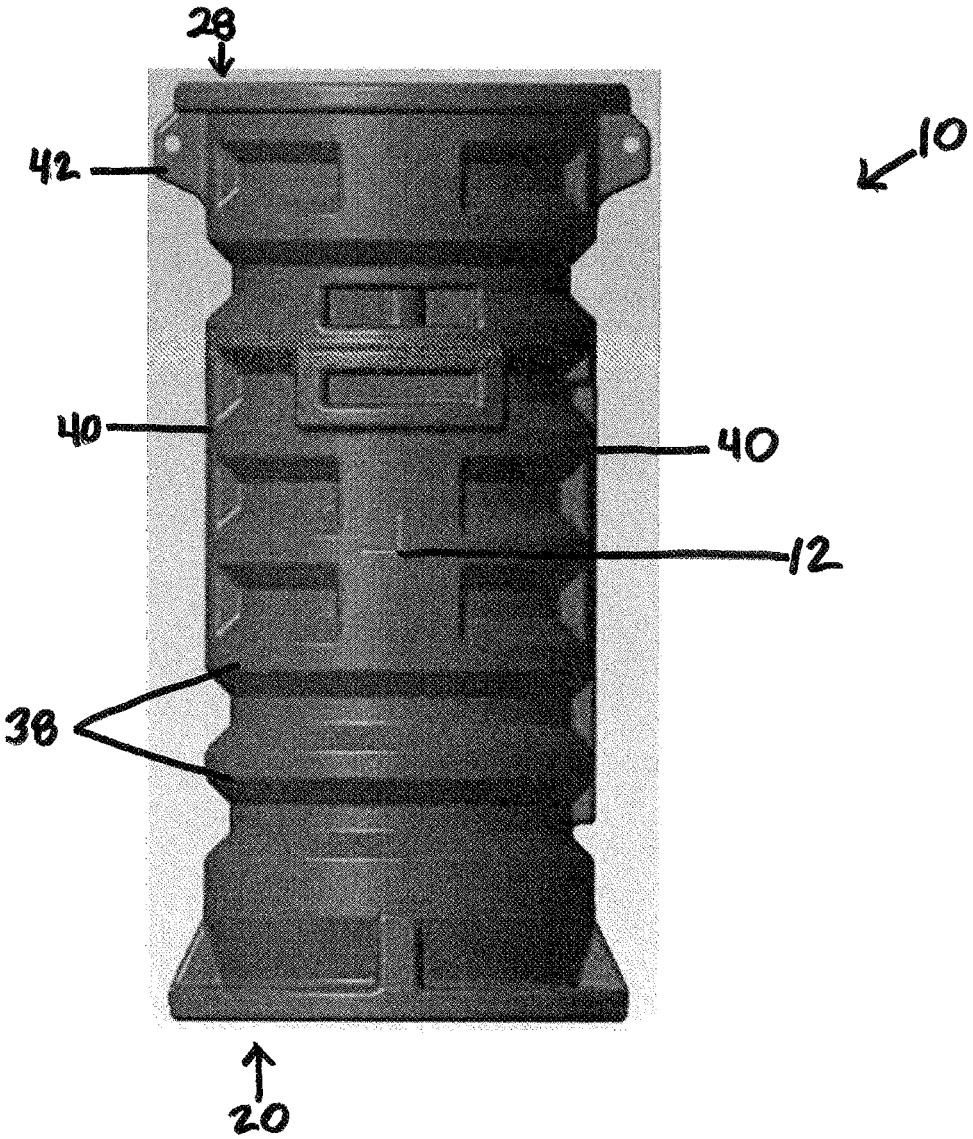
FIG. 1 is a side view of a wastewater basin for use with a submersible sump, sewage or grinder pump.
Figure 2:
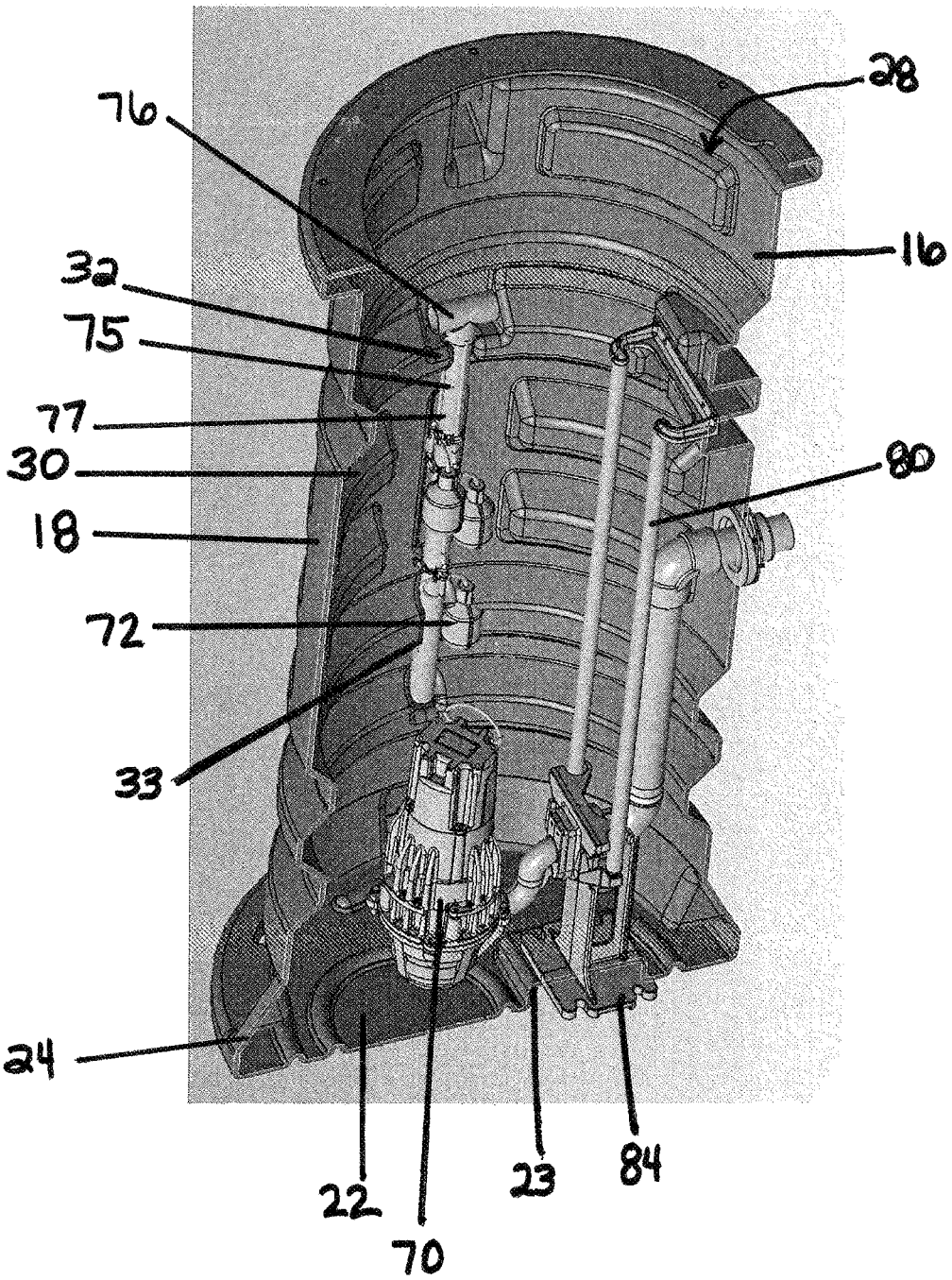
FIG. 2 is a top perspective, cutaway view of the basin of FIG. 1 showing the connection to the basin of a submersible pump with a guide rail system, discharge piping and a float tree with high water floats used with the sewage pump.
Figure 3:
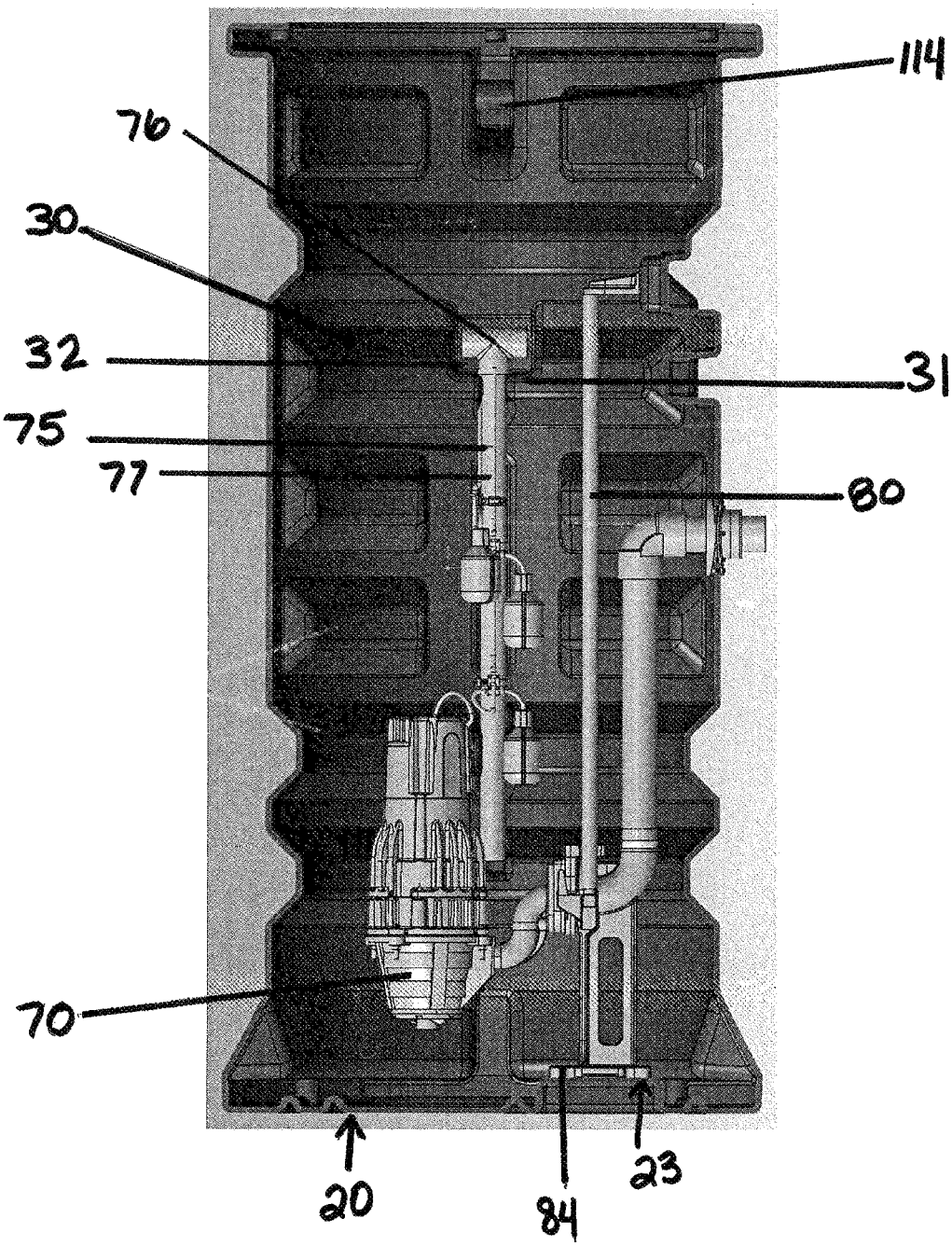
FIG. 3 is a side cutaway view of the basin of FIG. 2.

In one embodiment, as illustrated in FIGS. 1-3, the basin (10) is preferably formed as a plastic molded, basin body (12) containing a cylindrical wall (14) with an inner wall surface (16) and an outer wall surface (18), a closed bottom (20) with an inner surface (22) and an open top (28).

Figure 5:
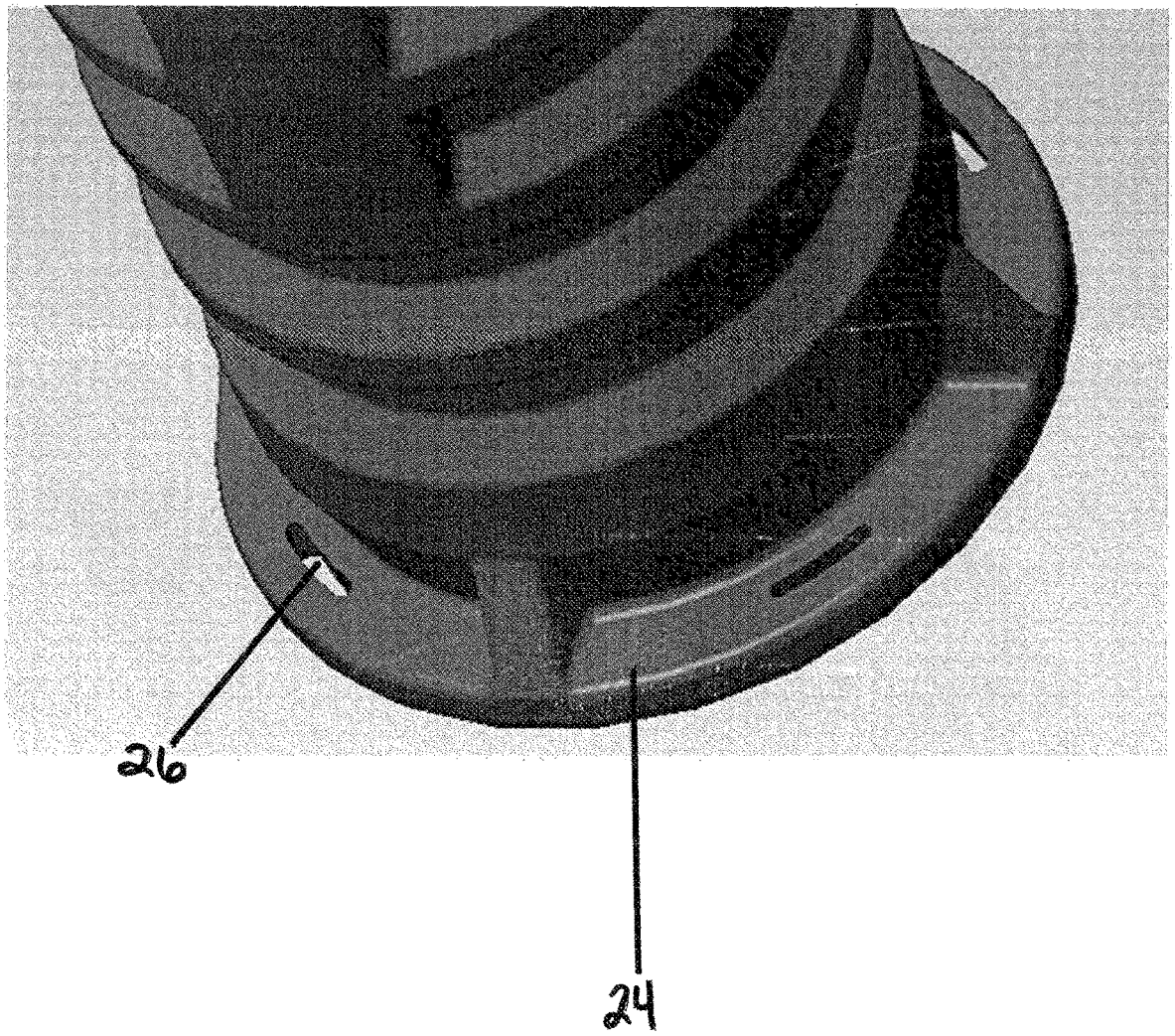
FIG. 5 is a partial perspective view of a bottom flange of the basin extending outward from a closed bottom of the basin of FIG. 1.

A bottom flange (24), which is preferably a molded component of the basin (10), extends outwardly from the closed bottom (20) about 2 to about 12 inches from the level of the outer wall surface of the basin. Contained within, and extending downward through, the bottom flange (24) are bolt down slots (26), as shown in FIG. 5. Typically, similar basins are installed by digging a hole, placing the basin in the hole and surrounding the basin with fill. Frequently, concrete is added to create proper balance and to prevent the tank from floating upward and popping out of the ground due to its buoyance under high ground water conditions. It has been discovered that to better retain the basin in a proper location within the ground, bolts are secured through the bolt down slots of the molded basin body into the concrete.

By the basin body (12) being formed from molded plastic, preferably recycled plastic, various design features can be incorporated into the structure of the basin body. These features provide significant improvements over prior art metal or fiberglass basins. For example, molded external horizontal ribs (38) and molded external vertical ribs (40), along with molded lifting lugs (42) are preferably molded into the outer wall surface (18) of the molded basin body, as shown in FIG. 1.

Figure 4:
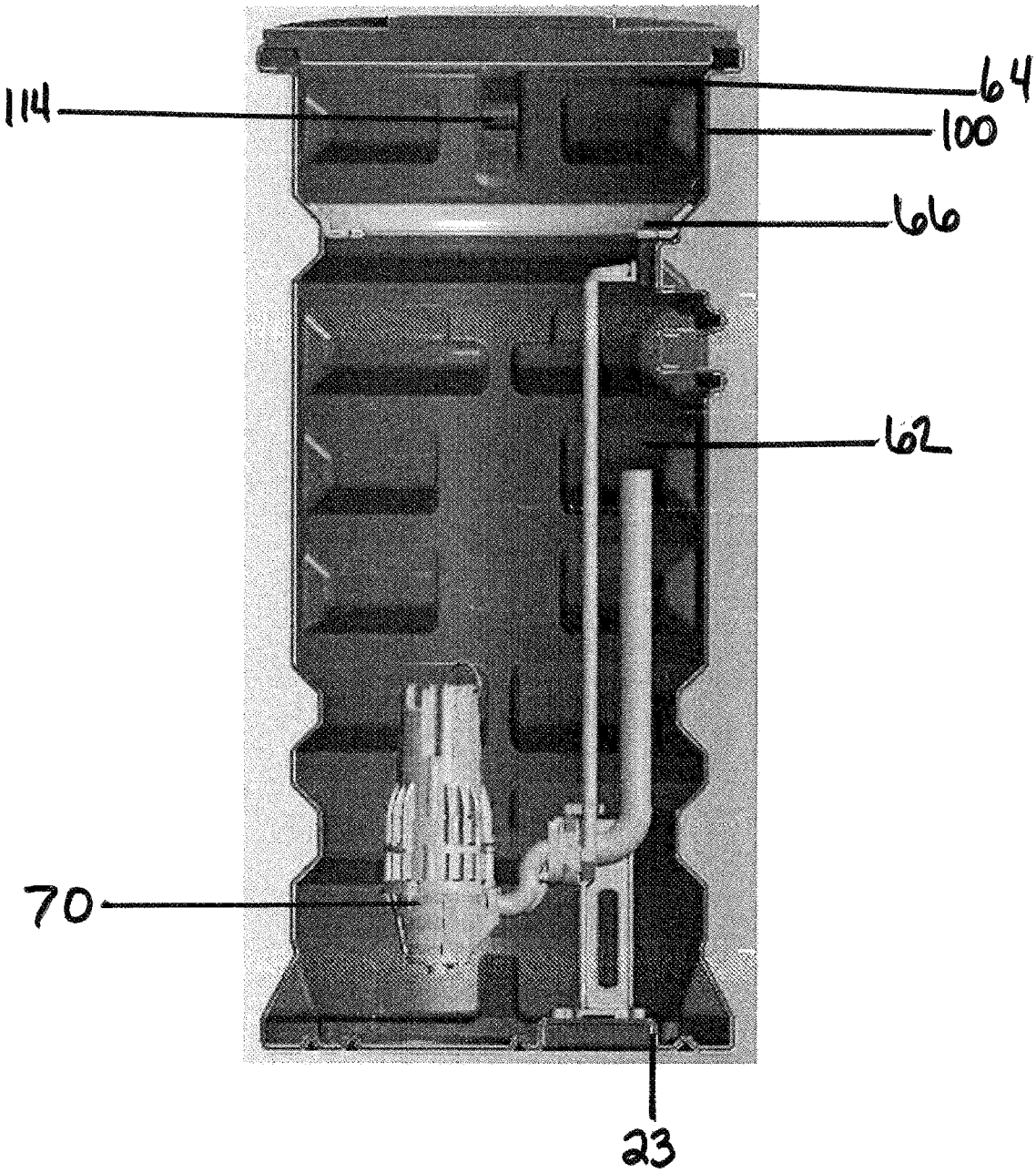
FIG. 4 is a side cutaway view of the basin of FIG. 2 showing use of a wet/dry well barrier.

In addition, inner facing horizontal ribs (30) are also preferably molded into the inner wall surface (16), as shown in FIGS. 2-4, which ribs are discussed in more detail later. Further, high water floats and alarms can be added and held in position by these molded ribs.

Conventional submersible sump, sewage or grinder pumps (70) utilize floats (72) which turn the pump on or off depending on the orientation of a switch float housing which is associated with the floats. Because these floats are located at different heights within the basin, conventionally, they are secured on a float tree. In the prior art, conventional float trees were secured to the basin by bolting them through the side walls of the basin. In a preferred structural arrangement, the molded basin body (12) includes a molded inner surface receiving bracket or brackets (32, 33) for the float tree (75), as shown in FIGS. 2 and 3. The molded inner surface receiving bracket or brackets are formed from one or more molded inner facing horizontal ribs (30) of the molded basin body. Slots (31) are provided in these brackets, which are sized to permit the float tree to snap into place and be held in that location securely. In this embodiment, the float tree is preferably formed from cylindrical piping which snaps into the slots, as shown in FIGS. 2 and 3. In one embodiment, as shown in FIGS. 2 and 3, the float tree comprises two pieces of cylindrical piping, an upper horizontal portion (76) joined with a vertical portion (77) of the float tree. At least the vertical portion of the float tree snaps into the slots of the brackets. The size of these slots is determined to hold the float tree in place at a fixed location within the molded basin body. By use of this design feature of the basin body, installation of the float tree within the basin is simple, places the float tree in the proper location for operational coordination with the pump, and does not require the use of metal brackets secured into and through the wall of the basin. Further, the float tree can be removed easily for repair, as necessary.

Figure 6:
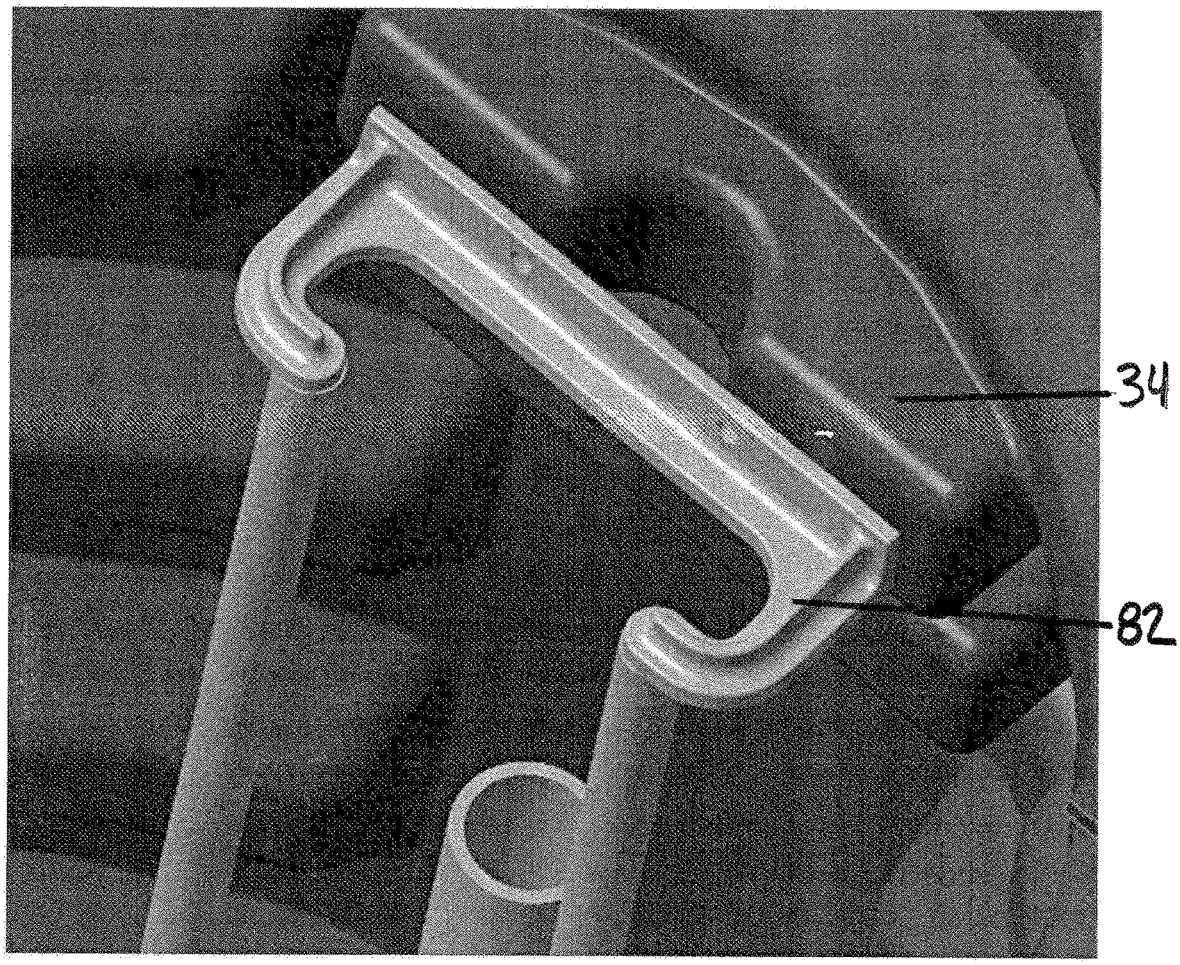
FIG. 6 is a partial inner cutaway view of a portion of the basin of FIG. 2 showing an inner surface support mount bracket secured to an inner basin mounting surface to support the guide rail system.

Because the pump (70) used within the basin body (12) is generally located near the closed bottom (20) of the basin, it is common to use a guide rail system (80), as shown in FIGS. 2 and 3, which permits the pump (70) to be raised and lowered within the basin easily. To support a base (84) of the guide rail system on the closed bottom of the basin, an upwardly extending molded base (23) is provided, as shown in FIGS. 2 and 3. Conventionally, the guide rail system is secured within a basin by use of brackets which are themselves secured through the surface of the basin. By using the disclosed molded basin body (12), it is possible to utilize a molded inner basin mounting surface (34), as shown in FIG. 6, which is molded into the inner surface (22) of the molded basin body. In one embodiment, this molded inner basin mounting surface creates a flat surface within the basin body against which an upper bracket (82) of the guide rail system (80) can be secured using a conventional securing system, such as bolts bolting the upper bracket to and through openings cut in the molded inner basin mounting surface (34) of the basin.

Figure 7:
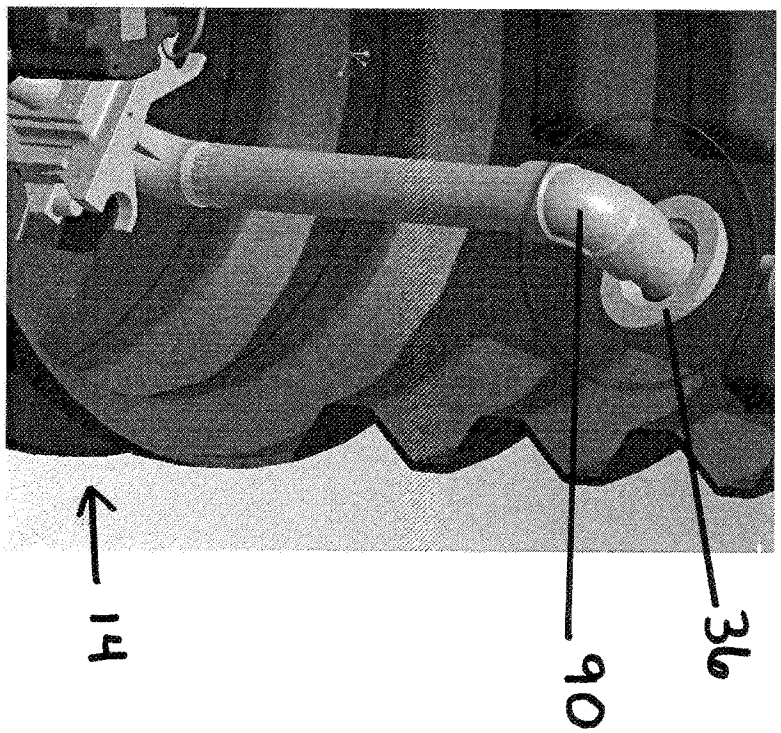
FIG. 7 is a partial inner cutaway view of a portion of the basin of FIG. 2 showing a discharge pipe for discharging wastewater from the basin.

Also present in the cylindrical wall (14) of the molded basin body, is a system to permit a discharge pipe (90) from the pump to pass through the wall of the basin. The discharge pipe preferably exits the basin through a pipe seal on an exterior vertical rib (40), as shown in FIG. 7.

Figure 8A:
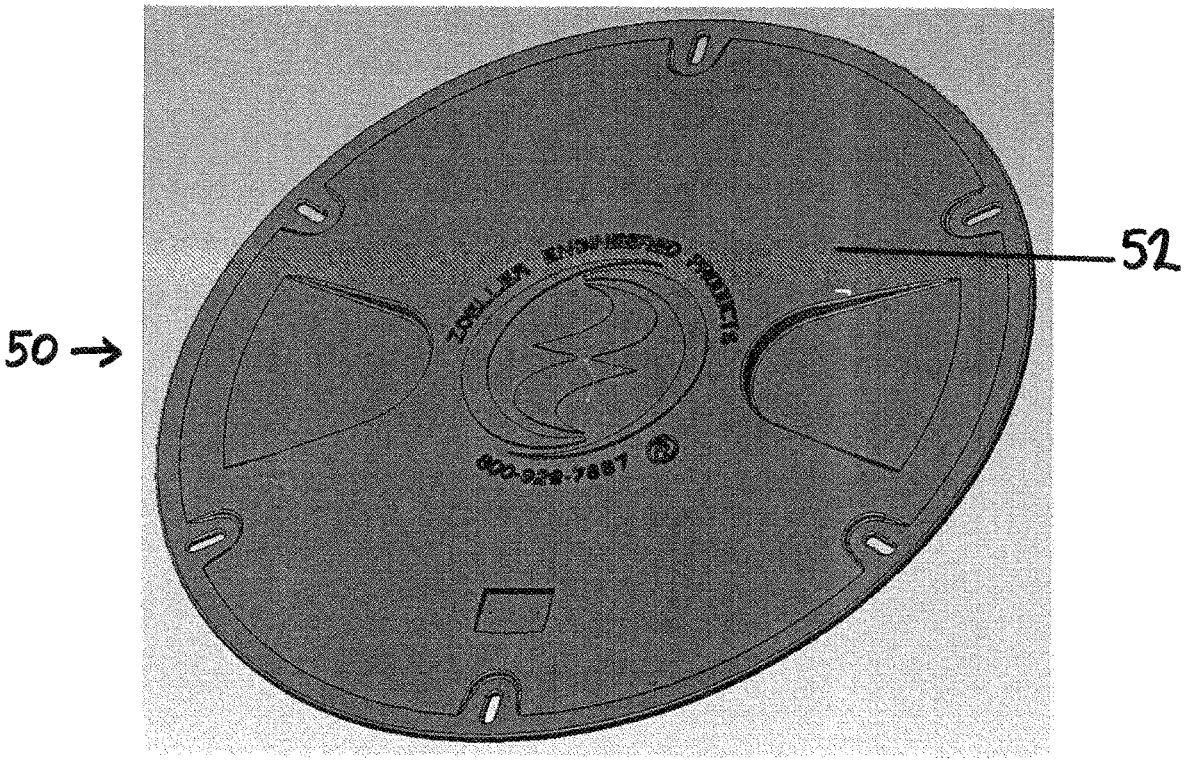
FIG. 8A is a top, perspective view of a cover for the basin of FIG. 1.
Figure 8B:
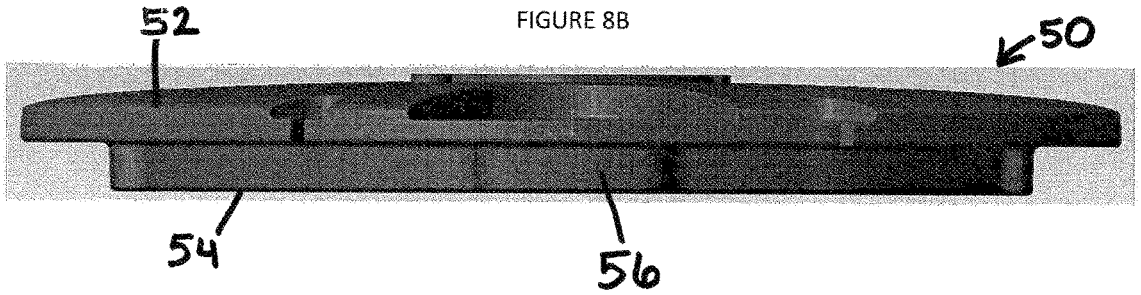
FIG. 8B is a side view of the cover of FIG. 8A.
Figure 8C:
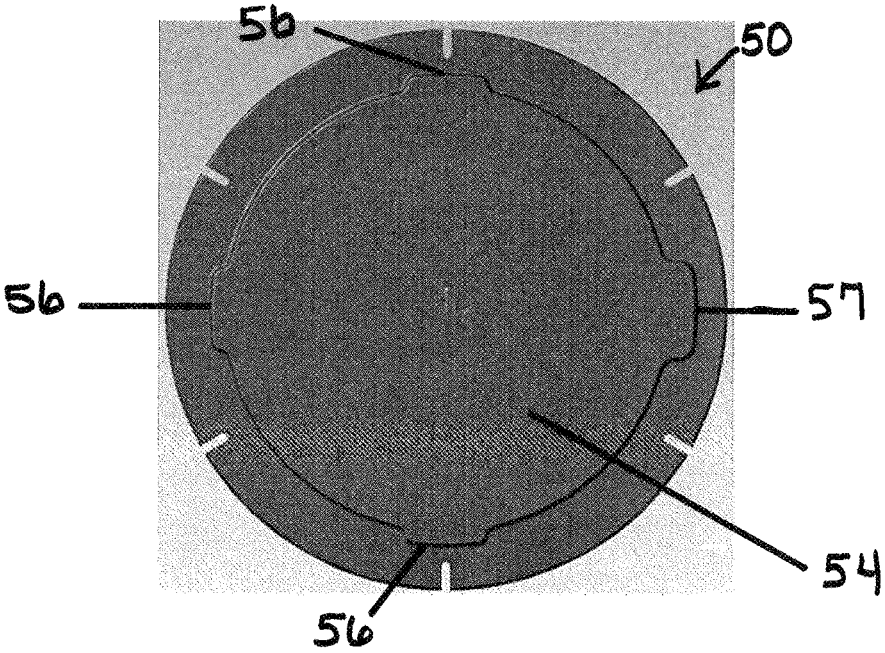
FIG. 8C is a bottom view of the cover of FIG. 8A.
Figure 9:
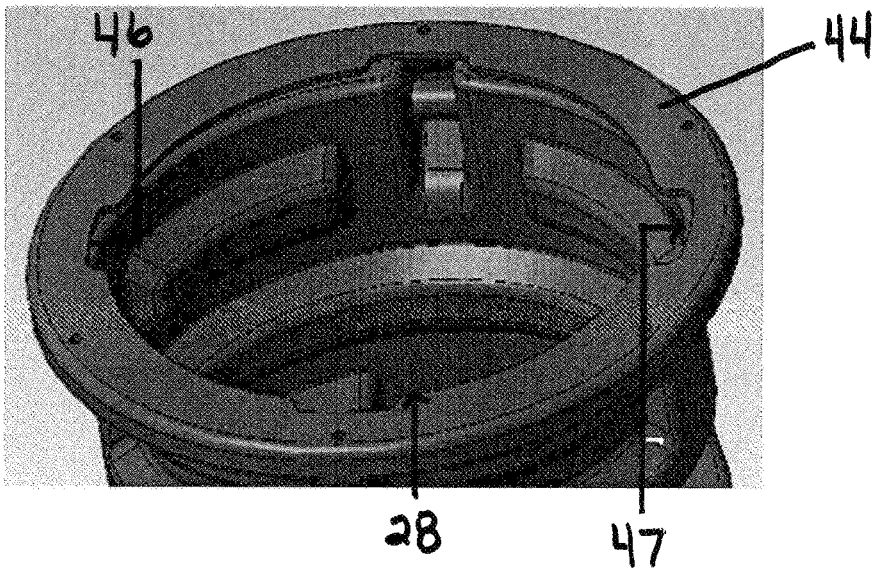
FIG. 9 is a side perspective cutaway view of an upper surface of an open top of the basin of FIG. 1 showing four molded depressions therein.

A cover (50) is secured on a top surface (44) of the open top (28) of the molded basin body (12), as shown in FIGS. 8A, 8B and 8C. The cover (50) has an upper surface (52) and a lower surface (54). The lower surface, as molded, includes multiple extrusions (56) in the lower surface of the cover near an outer edge thereof, as shown in FIG. 8B, with one of those extrusions (57) being larger in arc around a circumference of the outer edge of the lower surface of the cover. These extrusions (56, 57) are designed to fit within molded depressions (46) in the top surface of the open top of the molded basin body, as shown in FIG. 9. Preferably, one of these molded depressions (47) is larger in arc than the other openings. By this structure, the extrusions of the cover fit into the molded depressions (46, 47) in the top surface of the open top of the molded basin body to close the basin body and for easy opening. Because only the largest extrusion (57) fits into the largest molded depression (47), the cover fits in a precise arrangement to the basin to close the basin. For security, bolts are secured through the outer edge of the cover which extend through the top surface (44) of the open top to hold the cover securely in place.

Figure 10A:
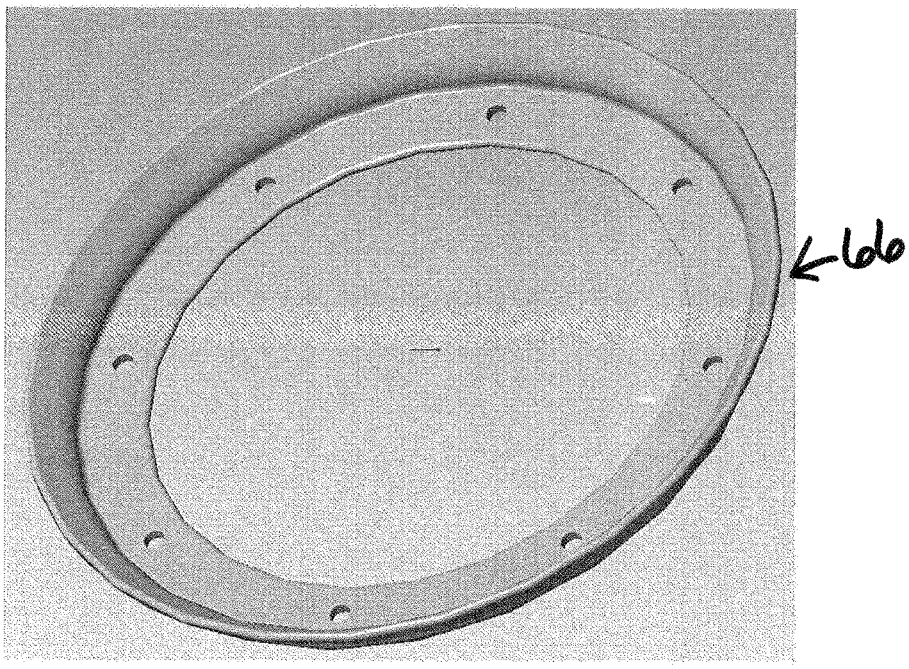
FIG. 10A is a perspective view of a ring portion of a disc of a wet/dry well barrier used with the basin of FIG. 1.
Figure 10B:
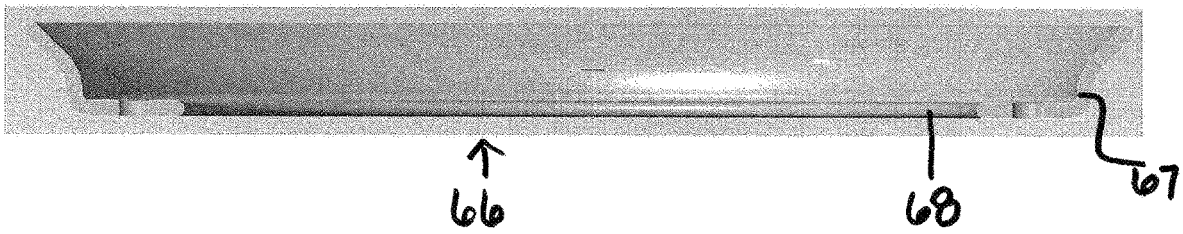
FIG. 10B is a side view of the ring portion of the disc of FIG. 10A.
Figure 10C:
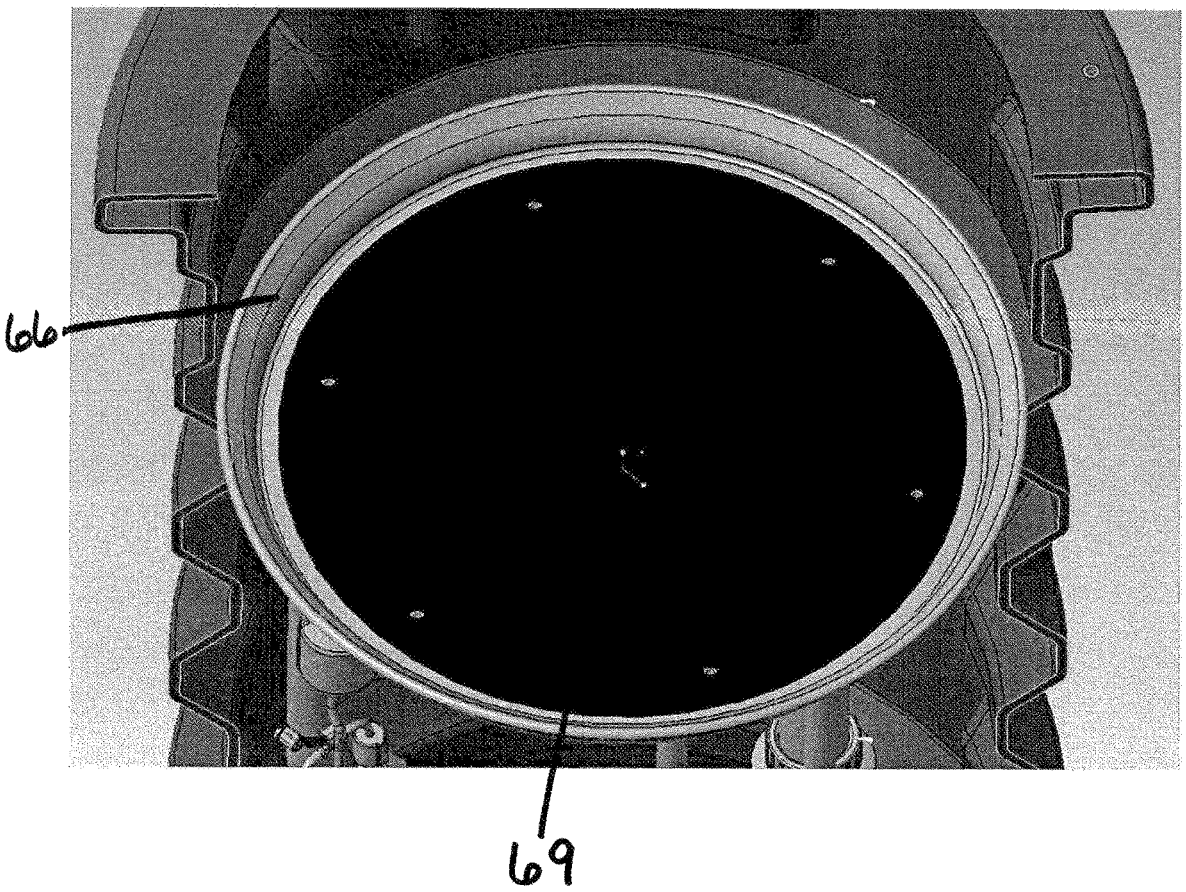
FIG. 10C is a bottom, perspective view of a plate in use with the ring portion of the disc of FIG. 10A.
Figure 11:
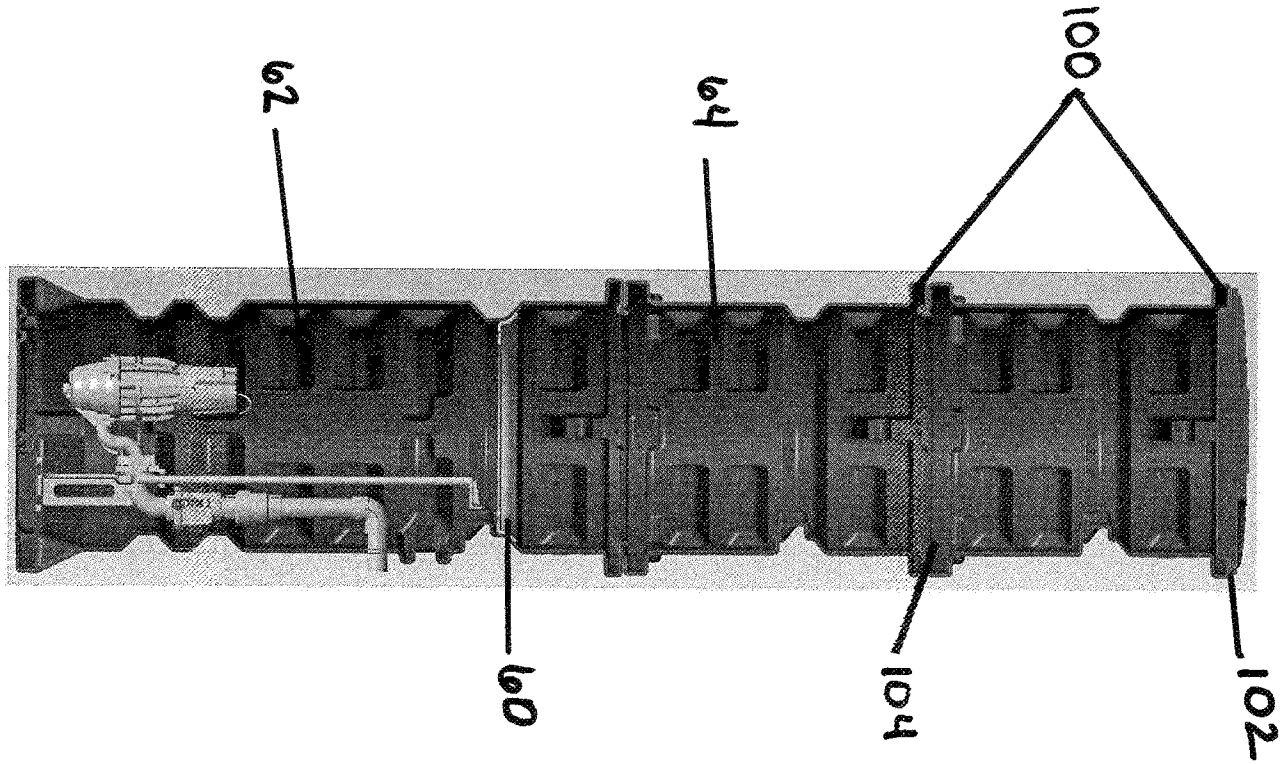
FIG. 11 is a side view of multiple extension risers supported by the disc of FIG. 10A secured to the basin of FIG. 4 and including the wet well/dry well disc.

Another important feature that is possible, because of the molded structure of the basin body, is the adaptability of the basin to create at different, selected locations within the basin a wet/dry well barrier (60), which separates a wet well portion (62) of the basin from a dry well portion (64), as shown in FIGS. 4 and 11. This wet/dry well barrier includes a ring portion of a disc (66) placed within the basin at a selected location. In one embodiment this ring portion has an outer lower edge (67) which is designed to be supported by a molded inner facing horizontal rib (30) of the molded basin body (12). This lower edge of the ring portion has an angled surface which matches an angle of the molded inner facing horizontal rib, as shown in FIGS. 10A and 10B. Openings are provided in the ring portion so that a plate (69) can be secured to that ring to form the disc that creates a barrier between the wet well and the dry well. (See FIG. 10C.) Because of the presence of multiple molded inner facing horizontal ribs in the basin body, this disc with plate can be moved upwards and downwards within the basin body to adjust the demarcation line between the wet well and the dry well.

Figure 12:
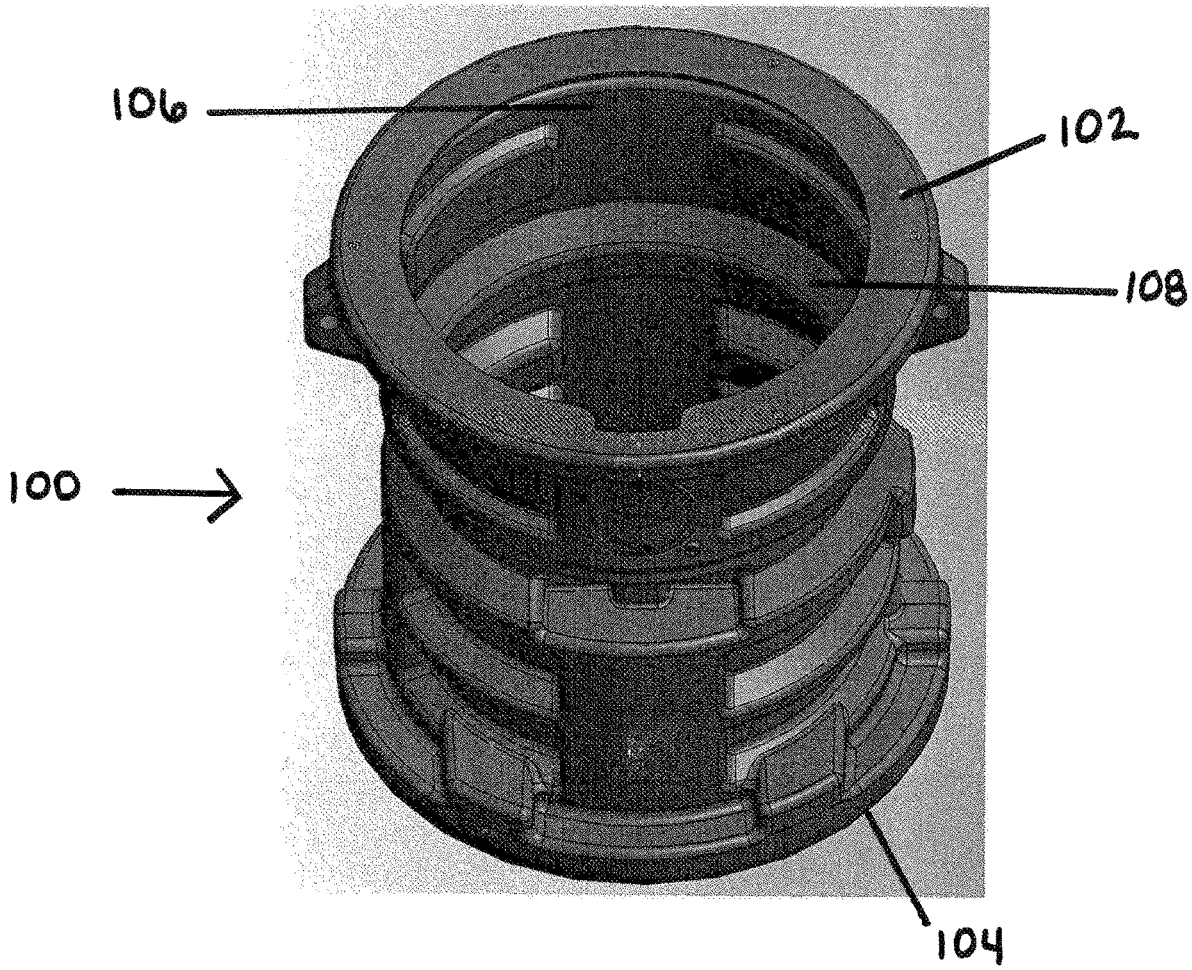
FIG. 12 is a top perspective view of one of the extension risers used with the basin of FIG. 11.
Figure 13A:
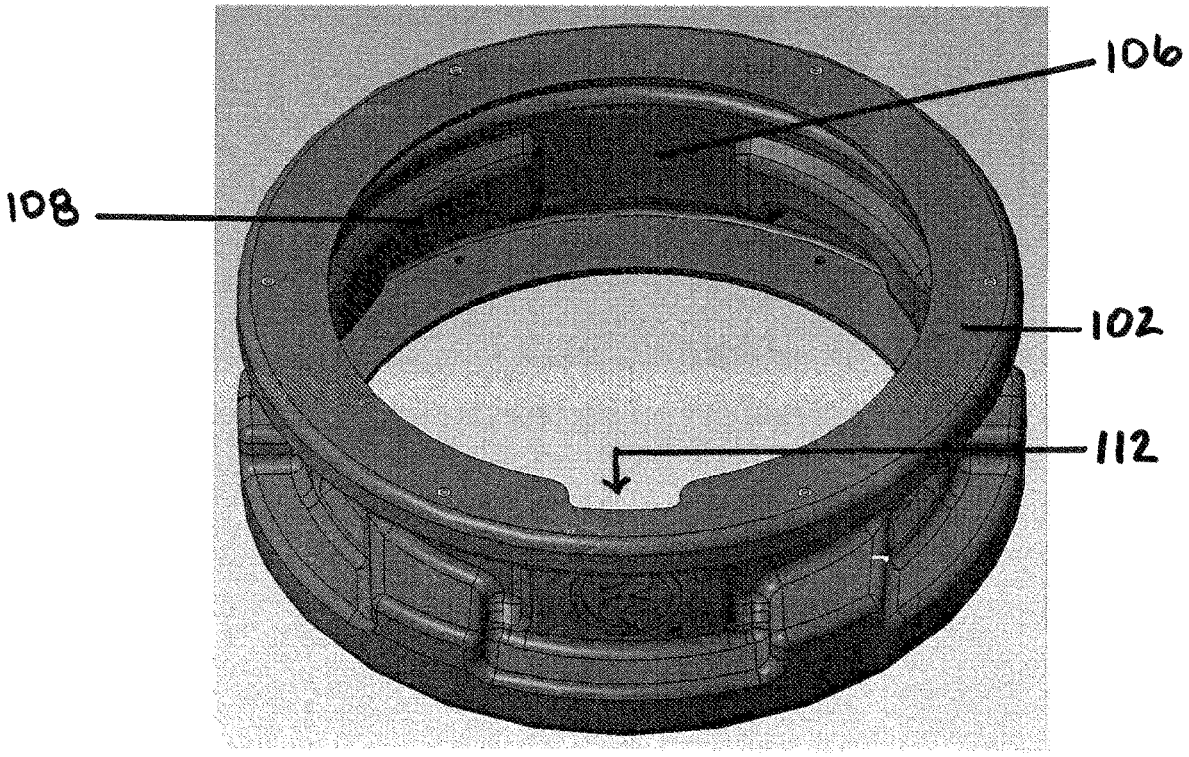
FIG. 13A is a top perspective view of a smaller extension riser than that shown in FIG. 12 that can be used with the basin of FIG. 1.
Figure 13B:
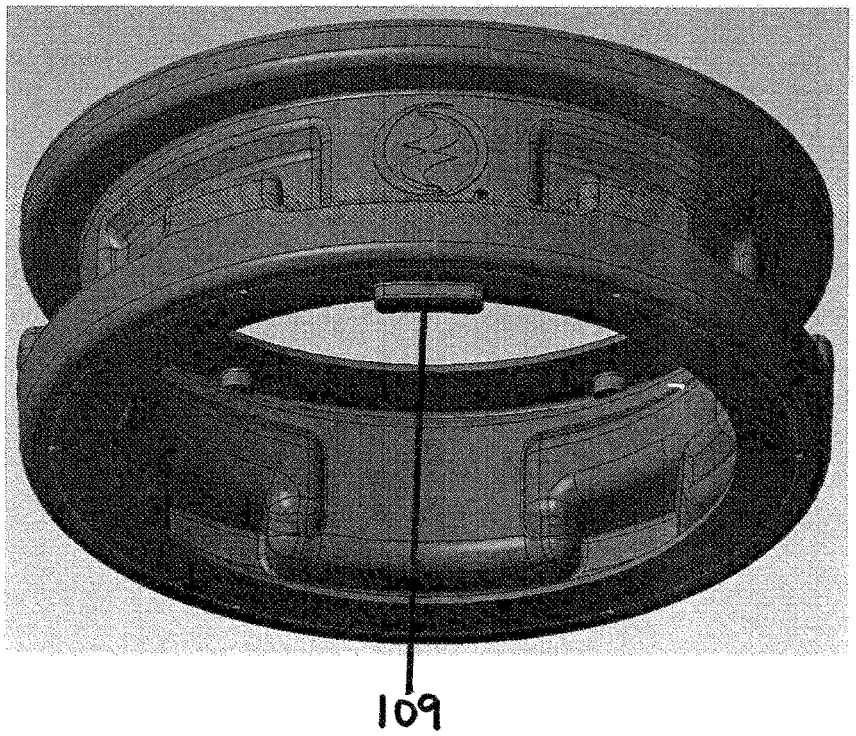
FIG. 13B is a bottom perspective view of the extension riser of FIG. 13A.
Figure 14:
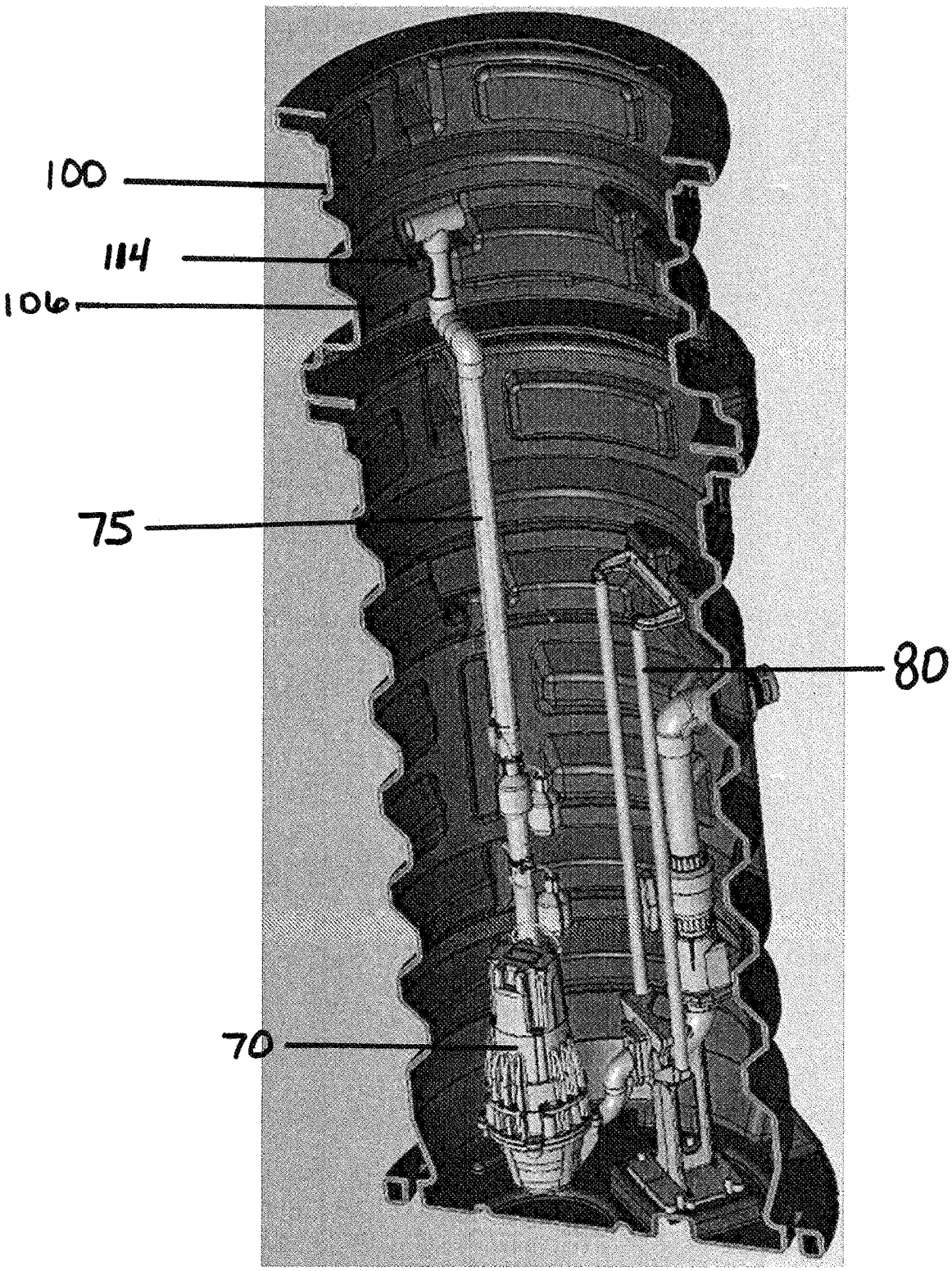
FIG. 14 is a cutaway, perspective view of the basin of FIG. 2 showing a float tree with high water floats secured within an extension riser secured to a wastewater basin.

It is useful for various embodiments that the basin has a height ranging from 36 inches to 84 inches. Accordingly, extension risers (100) may be formed and added to the basin to increase the overall height of the basin, as shown in FIGS. 4 and 11. These extension risers are molded with an inner surface which had similar design features to those of the basin. These extension risers have a top surface (102), a bottom surface (104) and an inner surface (106), as shown in FIGS. 12 and 13. The inner surface preferably includes molded inner facing horizontal ribs (108). As with the basin, these molded inner facing horizontal ribs can function as molded inner surface receiving brackets (114) for receiving the wet/dry well barrier (60) with the same structure and features as discussed for the brackets of the molded basin body.

Further, the bottom surface of the extension riser includes lugs which extend from the outer, bottom surface thereof and mate with molded depressions (46) in the top surface (44) of the open top of the basin. See FIG. 13B. One of the lugs is a larger lug (109), which mates with a larger molded depression (47) in the top surface of the open top of the molded basin body. Consistent with the top surface (44) of the open top (28) of the basin body is the design of the top surface (102) of the extension riser which contains slots (112) with one of those slots being a larger slot. By this structure the cover (50) can be secured onto the top surface (102) of the extension riser (100) in the same way as it is secured to the top surface of the basin body.

It is also possible to extend the float tree (75) into the extension element, as there is provided in the inner surface of the extension riser an inner surface receiving bracket (114) to hold the float tree in proper position. See FIG. 14.

Various height extension risers can be used. For example, the height may be 12 inches to 48 inches, or any convenient height, which extends the overall height of the basin (10). Multiple extension risers can be used, as shown in FIG. 11.

The foregoing is considered illustrative only of the principles of disclosure for the modifications and changes may readily occur to those skilled in the art in this disclosure it is not intended to limit the disclosure of the exact construction operation shown and described. Accordingly, suitable modifications of equivalence may be resorted to and are within the scope of the disclosure.

LIST OF ELEMENTS

10 Wastewater basin
12 Molded basin body
14 Cylindrical wall of 12
16 Inner wall surface of 14
18 Outer wall surface of 14
20 Closed bottom of 12
22 Inner surface of 20
23 upwardly extending molded base of 80
24 Bottom flange of 20
26 Bolt down slots of 26
28 Open top of 12
30 Molded inner facing horizontal ribs of 12
31 Slots in 30
32 Molded inner surface receiving bracket for float tree
33 Additional receiving bracket for float tree
34 Inner basin mounting surface
36 Pipe seal system of 90
38 Exterior horizontal ribs
40 Exterior vertical ribs
42 Lifting lugs
44 Top surface of 28
46 Molded depressions in 44
47 Larger opening in 44
50 Cover
52 Upper surface of 50
54 Lower surface of 50
56 Multiple extrusions of 54
57 Larger extrusions of 54
60 Wet/dry well barrier
62 Wet well portion of 10
64 Dry well portion of 10
66 Ring portion of disc of 60
67 Lower edge of 66
68 Bottom surface of 66
69 Plate
70 Pump
72 Floats
75 Float tree
76 Upper horizontal portion of 75
77 Vertical portion of 75
80 Guide rail system
82 Upper bracket of 80
84 Base of guide rail system
90 Discharge pipe of 70
100 Extension riser
102 Top surface of 100
104 Bottom surface
106 Inner surface of 100
108 Inner facing horizontal rib 100
109 Larger lug
112 Slots of 102
114 Inner surface receiving bracket for float tree

The invention claimed is:

1. A wastewater basin for use with a sump, sewage or grinder pump comprising a molded basin body comprising a generally cylindrical wall including an inner wall surface and an outer wall surface;

an open top of the basin body;

a closed bottom of the basin body with an inner surface;

a bottom flange extending outward from the closed bottom; and a cover to close the open top of the basin body;

wherein the inner wall surface of the basin body includes a molded inner surface receiving bracket comprising one or more ribs of the inner surface with one or more slots therein to secure a float tree within the basin and wherein the receiving bracket forms an element of the inner surface and an element of the outer surface of the basin.

2. The basin of claim 1 wherein the inner wall surface of the basin body further comprises a molded inner basin mounting surface with a generally flat surface to which is securable to a bracket of a guide rail system used with the pump.

3. The basin of claim 1 further comprising a pipe seal located in the cylindrical wall for receiving a discharge pipe from the pump.

4. The basin of claim 1 wherein the outer wall surface of the molded basin body comprises molded exterior horizontal ribs and molded exterior vertical ribs.

5. The basin of claim 1 wherein the outer wall surface of basin body comprises molded lifting lugs.

6. The basin of claim 1 wherein the bottom flange contains bolt down slots.

7. A wastewater basin for use with a sump, sewage or grinder pump comprising a basin body comprising a generally cylindrical wall including an inner wall surface and an outer wall surface;

a molded inner basin mounting bracket comprising one or more slots to secure a float tree within the basin;

an open top of the basin body;

a closed bottom of the basin body with an inner bottom surface;

a bottom flange extending outward from the closed bottom; and a cover to close the open top of the basin body, wherein the inner wall surface of the basin body includes a molded inner surface support comprising a generally flat surface which is securable to a support for a guide rail system, and wherein the inner bottom surface of the closed bottom of the basin body includes an upwardly extending molded base that is integral therewith to support a base of the guide rail system of the pump.

8. The basin of claim 7 further comprising a wet/dry well barrier supported within the basin of the inner wall surface by a molded horizontal rib to form a barrier between a wet well portion and dry well portion of the basin.

9. The basin of claim 7 further comprising a pipe seal located in the cylindrical wall for receiving a discharge pipe from the pump.

10. The basin of claim 7 wherein the outer wall surface of the molded basin body comprises molded exterior horizontal ribs and molded exterior vertical ribs.

11. The basin of claim 7 wherein the outer wall surface of basin body comprises molded lifting lugs.

12. The basin of claim 7 wherein the bottom flange contains bolt down slots.

* * * * *